United States Patent [19]

Brown

[11] 4,342,395

[45] Aug. 3, 1982

[54] LIQUID DISPENSING UNIT AND METHOD OF MANUFACTURE THEREOF

[76] Inventor: James B. Brown, R.F.D. #2, Box 313, Mt. Kisco, N.Y. 10549

[21] Appl. No.: 230,604

[22] Filed: Feb. 2, 1981

[51] Int. Cl.[3] ..... B65D 85/42; B65B 83/00; B65B 11/00

[52] U.S. Cl. ..... 206/530; 206/528; 206/534; 206/484; 206/820; 53/396; 53/449; 53/450; 128/272

[58] Field of Search ..... 206/528, 529, 530, 534, 206/484, 820; 53/396, 449, 450; 128/272

[56] References Cited

U.S. PATENT DOCUMENTS

| | | | |
|---|---|---|---|
| 2,371,667 | 3/1945 | Arena et al. | 206/528 |
| 2,546,848 | 3/1951 | Bishop | 206/530 |
| 3,039,246 | 6/1962 | David | 206/484 |
| 3,266,625 | 8/1966 | Hardman | 206/820 |
| 3,380,578 | 4/1968 | Sparks | 206/484 |
| 3,856,142 | 12/1974 | Vessalo | 206/534 |

*Primary Examiner*—William T. Dixson, Jr.
*Attorney, Agent, or Firm*—Alfred E. Miller

[57] ABSTRACT

A liquid dispensing package from two continuous abutting strips having opposed recesses provided with spaced holes and forming substantially cylindrical chambers for individual ampoules. The strips are heat sealed together and non-woven fabric is heat sealed to the outer sides of said strips. Individual liquid dispensing packages are die-cut from strips with each having a peripheral flange. The liquid dispensing package can be manually crushed whereby the liquid in the ampoule penetrates through said fabric.

9 Claims, 7 Drawing Figures

10
12
14
16
18
20
21
22
23
24
25
26
30
34
36
38
40
46
17

LIQUID DISPENSING UNIT AND METHOD OF MANUFACTURE THEREOF

The present invention relates to improvements in a liquid dispensing unit of the frangible and disposable type and a high speed manufacturing system for producing said units.

Encapsulated liquid dispensing packages are known, for example, as ammonia inhalants. However, one of those devices presently available has the disadvantage that it is manufactured by a multi-stage operation in which a vial is covered with a waffle type fabric that permits penetration of the ammonia inhalant liquid upon fracture of the vial. In addition, an instruction sheet is placed on the waffle fabric and covered by a silk exterior netting. Finally, the fabric and netting are closed at opposite ends by staples. Another type of liquid dispensing unit encapsulates a frangible or crushable vial with several layers of porous paper which are laminated together. However, this particular unit suffers from the disadvantage that the container easily delaminates when the vial is broken, thus seriously reducing the usefulness of the package.

The present invention utilizes a high speed fabrication system for liquid dispensing units, and particularly ammonia inhalant packages, which are encapsulated within a continuous and moving upper and lower strip of thermoplastic sheeting in which each strip has a series of half cylindrical depressions that are mated together to form cylindrical pockets for receiving crushable, liquid-containing vials. In the manufacturing process, holes are punched in each of the depressions, and the complementary strips are heat sealed together on their flat abutting faces. A process of mating complementary strips of thermoplastic material is shown in my U.S. Pat. No. 4,183,684, issued on Jan. 15, 1980.

After the complementary strips are heat-sealed together, a fabric is applied to both the upper and lower surfaces thereof and heat-sealed thereto. An additional step can be utilized in which labels constituted of a heat-sealing paper are applied to the fabric conforming to the outer curvilinear surface over each of the pockets, and heat-sealed thereto. Finally, a die cutter is employed to punch out each of the liquid dispensing units while the scrap strip continues to move linearly and to be wound around a take-up roller.

The manufacture and assembly operation described hereinabove permits production of 150 to 200 liquid dispensing units or packages per minute from continuous strip.

It is an object of the present invention to provide a high speed production line for liquid dispensing units, such as ammonia inhalant packages, which are fabricated from continuous thermosplastic strips.

It is another object of the present invention to provide an ammonia inhalant package that is simple and inexpensive to fabricate, as well as being safe to use.

In order that the invention will be more clearly understood, it will now be disclosed in greater detail with reference to the accompanying drawings, in which.

Figures 6, 7:
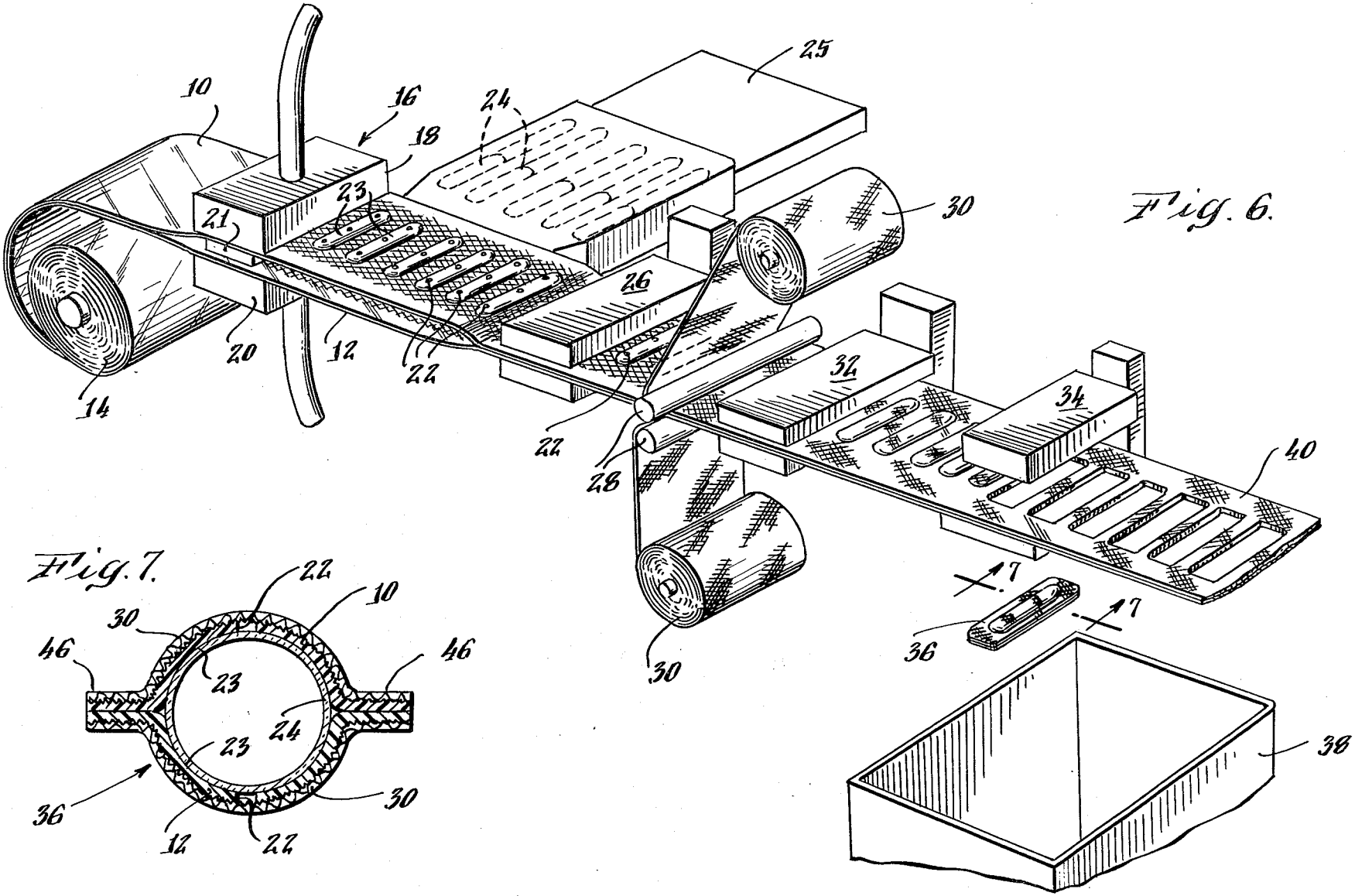
FIG. 6 is a perspective view of the manufacturing assembly line showing liquid dispensing units being fabricated from continuous thermoplastic strips.
FIG. 7 is an enlarged cross sectional view taken on lines 7—7 of FIG. 6, which shows an individual liquid dispensing unit or package in cross section.

As seen in FIG. 6, the manufacturing process for a high speed production line for producing liquid dispensing units from continuous thermoplastic strips is shown wherein said upper strip 10 and lower strip 12 are fed to the apparatus from a supply roll 14. The strips 10 and 12 pass between a device referred to generally by the reference numeral 16, and having an upper air pressure housing 18 and a lower air pressure housing 20, as well as an intermediate air pressure device 21, positioned between the strips to force air against said strips so that semi-cylindrical depressions 23 are formed in the strips in the adjacent air pressure housing. Thus, by air pressure means semi-cylindrical depressions are formed in both the upper and lower thermoplastic strips which are complementary in configuration. In addition, a device, not shown, is utilized to puncture the depressions at spaced locations to produce holes 22.

Prior to mating the upper thermoplastic strip with the lower thermoplastic strip, a series of frangible or crushable vials 24 are shown which are pushed laterally into the semi-cylindrical depressions of the lower thermoplastic strip 12 by means of a reciprocating pusher 25.

The thermoplastic strips 10 and 12 are then mated together and heat sealed by heat device 26, as the strips pass therethrough.

The combined strips 10 and 12 continue to move linearly and pass between rollers 28 through which a non-woven cloth webbing 30, having at least 50% polyester, is supplied to both the top and the bottom surfaces of the combined thermoplastic strips 10 and 12 from supply rollers 30. Thereafter, the continuously moving strips pass through a heat sealing device 32 by means of which the non-woven fabric is applied to the entire top and bottom surfaces of said strips. Combined strips 10 and 12 continue to move linearly, and pass between die cutters 34 which punch out individual liquid dispens-packages 36 that drop in succession into a container 38. The scrap strip 40, with rectangular openings therein, continues to move to a take-up roller (not shown) for processing.

Figure 1:
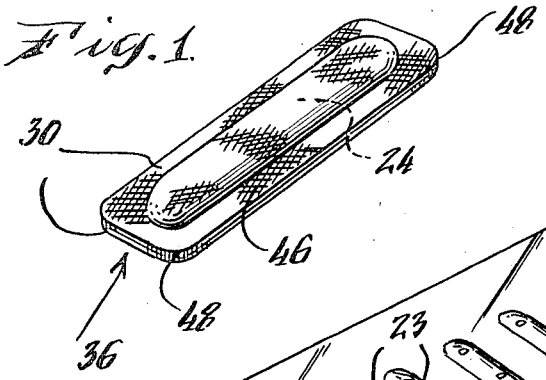
FIG. 1 is a perspective view of a liquid dispensing unit which is fabricated from continuous thermoplastic strips, and to which a fabric covering has been applied to the top and bottom thereof.
Figure 2:
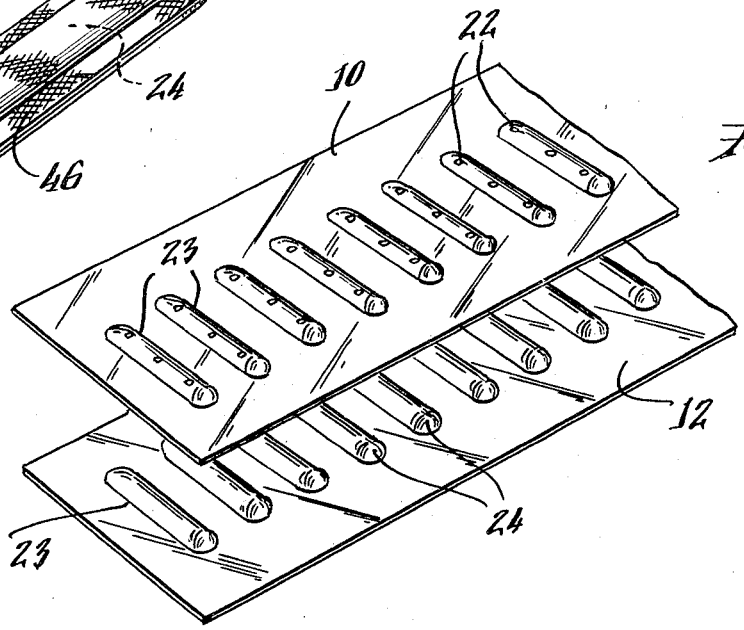
FIG. 2 is a partial exploded view of two thermoplastic sheets prior to being mated together to form cylindrical pockets for receiving crushable, liquid containing vials.
Figure 3:
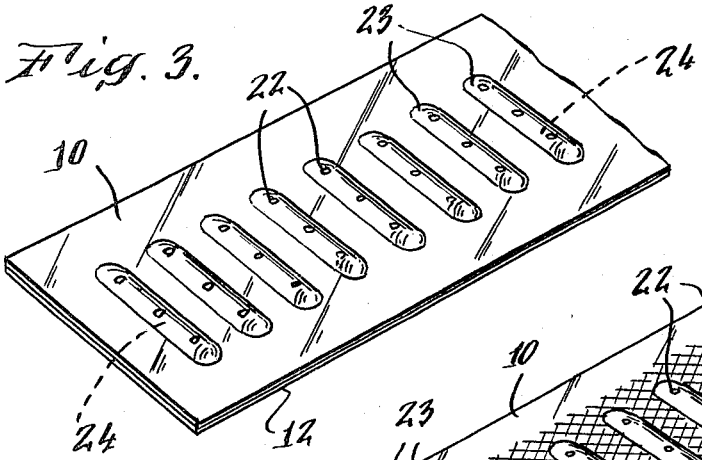
FIG. 3 is a partial perspective view of two thermoplastic strips showing cylindrical pockets with liquid containing vials therein.
Figure 4:
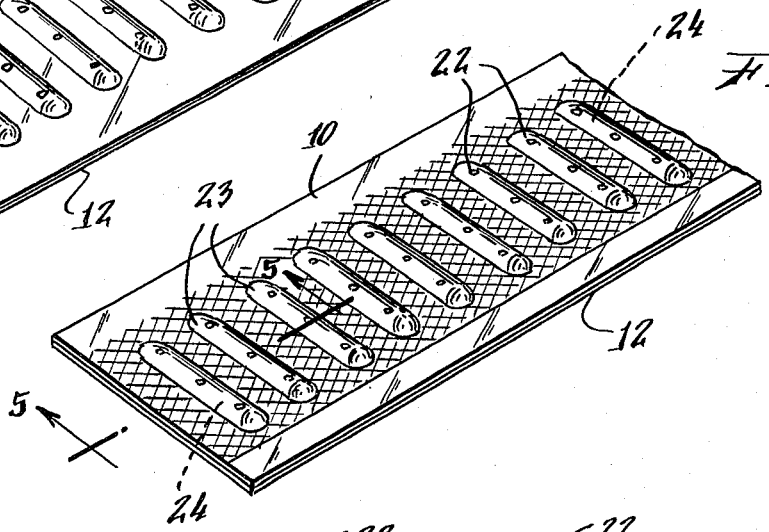
FIG. 4 is a partial perspective view of the mated thermoplastic strips which are heat sealed together.
Figure 5:
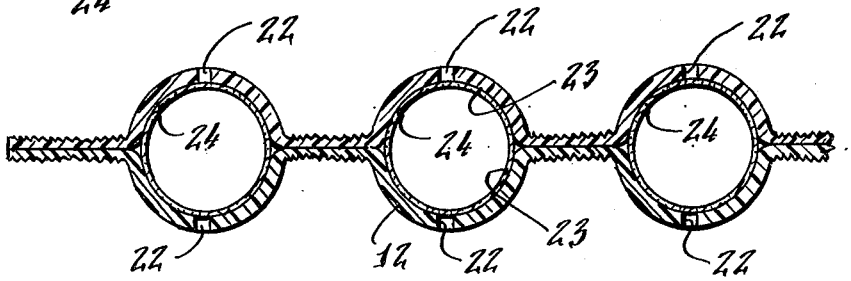
FIG. 5 is a sectional view taken along the lines 5—5 of FIG. 4.

As seen in FIG. 1, each liquid dispensing unit is provided with a cylindrical chamber containing a glass vial 24 containing a liquid substance, such as an ammonia inhalant, and a non-woven cloth 30 which is heat-sealed to the top and bottom portions thereof, and including the peripheral flange 46 so that when the vial 24 is manually crushed, the liquid penetrates through the holes 22 in the cylindrical chamber to be absorbed by said fabric 30 and escapes to the atmosphere in the form of a gas.

The utilization of thermoplastic chambers for glass vials 24 overcomes a disadvantage of prior frangible and disposable liquid dispensing packages, such as ammonia inhalants, in that the plastic material of each chamber is sufficiently tough to prevent the broken glass of the vial from penetrating to the exterior of the package, thereby cutting or lacerating the fingers of the user. It should also be noted that the corners 48 of the peripheral flange are rounded in order to prevent injury to the user.

The apparatus shown in FIG. 6, and described herein, results in the high speed manufacture of liquid dispensing units or packages from continuous strips wherein the individual liquid dispensing units are fabricated with a minimum number of operations, and which results in safe and reliable liquid dispensing small packages of the frangible and disposable type.

What is claimed is:

1. A liquid dispensing unit comprising: a cylindrical crushable glass vial having a liquid therein, a plastic blister package having identical complementary recesses forming a chamber for said glass vial and flange sections extending in a plane parallel to the longitudinal axis of said unit, a plurality of spaced holes in each of said recesses, and a non-woven fabric web applied to the top and bottom surfaces of said blister package whereby when said vial is crushed at least a major portion of said liquid passes through said holes in said recesses to penetrate through said non-woven cloth.

2. A liquid dispensing unit as claimed in claim 1 wherein said plastic blister package is formed of two complementary semi-cylindrical depressions which are mated together and heat-sealed to form a cylindrical chamber for receiving said vial.

3. A method of manufacturing a liquid dispensing unit comprising: supplying two spaced thermoplastic strips moving linearly, forming opposed semi-circular recesses in said plastic strips with spaced holes therein, inserting vials or ampoules in each of said recesses in one of said strips, moving said strips together with their opposed flat faces abutting and said opposite semi-circular recesses aligned to form chambers for said vials, heat sealing said strips together, heat sealing a non-woven fabric to each of said strips on opposite sides thereof, and die cutting individual liquid dispensing packages from said strips whereby each has a chamber, and a peripheral flange to form a manually crushable liquid dispensing unit whereby the liquid passes through said holes and penetrates said fabric.

4. A liquid dispensing unit as claimed in claim 1 further comprising a label heat-sealed to the exterior surface of said non-woven fabric.

5. A method of manufacturing a liquid dispensing unit as claimed in claim 3 further comprising the step of applying a label to the exterior surface of said non-woven fabric on each of said liquid dispensing units, and heat sealing the same thereto.

6. A method of manufacturing a liquid dispensing unit as claimed in claim 3 further comprising moving the scrap strips with openings therein to a location for reprocessing.

7. A liquid dispensing unit as claimed in claim 1 wherein the corners of said flange sections are rounded.

8. A method of manufacturing a liquid dispensing unit as claimed in claim 3 wherein at least five vials are inserted at once into corresponding semi-circular recesses in one of said thermoplastic strips.

9. A method of manufacturing a liquid dispensing unit as claimed in claim 3 wherein said opposed semi-circular recesses in said plastic strips are formed simultaneously by means of a pressure forming device.

* * * * *